United States Patent [19]

Welch et al.

[11] 4,206,831

[45] Jun. 10, 1980

[54] LOUDSPEAKER COUPLER

[75] Inventors: Robert B. Welch, 6324 SE. 28th St., Portland, Oreg. 97202; Joseph W. Griffith, Portland, Oreg.

[73] Assignee: Robert B. Welch, Milwaukie, Oreg.

[21] Appl. No.: 899,827

[22] Filed: Apr. 24, 1978

Related U.S. Application Data

[63] Continuation of Ser. No. 671,253, Mar. 29, 1976, abandoned.

[51] Int. Cl.[2] ..... G10K 13/00; G10K 11/00

[52] U.S. Cl. ..... 181/159; 181/180; 181/193; 181/196

[58] Field of Search ..... 181/152, 159, 192, 196, 181/180, 190, 193; 179/115.5 H, 1 E

[56] References Cited

U.S. PATENT DOCUMENTS

| | | | |
|---|---|---|---|
| 1,542,906 | 6/1925 | Pace | 181/192 |
| 1,656,140 | 1/1928 | Burk | 181/193 |
| 1,685,086 | 9/1928 | Hutchison | 181/159 |
| 1,722,220 | 7/1929 | Hurlbert | 181/192 |
| 1,755,636 | 4/1930 | Dubilier | 181/159 |
| 1,878,088 | 9/1932 | Zwikker | 181/159 |
| 2,160,166 | 5/1939 | Pausin | 181/190 |
| 2,801,703 | 8/1957 | Martin | 181/152 |
| 2,815,087 | 12/1957 | Delort | 181/192 |
| 2,878,887 | 3/1959 | Potter | 181/152 |
| 2,994,399 | 8/1961 | Zimmerman et al. | 181/152 |

*Primary Examiner*—L. T. Hix
*Assistant Examiner*—Benjamin R. Fuller
*Attorney, Agent, or Firm*—Oliver D. Olson

[57] ABSTRACT

An electrically driven loudspeaker is coupled to the atmosphere, which is to carry sound to the human ear, through a hollow coupler the inlet end of which has a cross sectional area comparable to the effective area of the loudspeaker, said cross sectional area decreasing progressively from said inlet end to an outlet end of substantially smaller cross sectional area. In a specific embodiment of the invention, an exponential horn is formed within the confines of a loudspeaker cabinet enclosure, and the inlet end of the horn is coupled to the electrically driven loudspeaker by means of the hollow coupler also formed within the cabinet enclosure. The outlet end of the coupler has the same cross sectional area and shape as the inlet end of the horn.

15 Claims, 13 Drawing Figures

LOUDSPEAKER COUPLER

This is a continuation of application Ser. No. 671,253, filed Mar. 21, 1976 now abandoned.

BACKGROUND OF THE INVENTION

This invention relates to loudspeakers, and more particularly to novel means by which to couple the driven component of a loudspeaker to the atmosphere.

Loudspeakers and other types of sound reproducers heretofore have been coupled directly to the atmosphere using such devices as Helmholtz resonators, acoustic suspensions, infinite baffles, tuned ports and others to alter the out-of-phase sound emanating from the rear of the driving unit. These devices provide a "system resonance" intended to reinforce low frequency drivers so as to achieve a "flat" response curve. Such devices introduce sounds that are not present in the original music and they also cause distortions created by their sharply defined boundaries. These artificial sounds and distortions are further amplified when they are fed through exponential horns.

Exponential horns are recognized as very effective devices for coupling sound reproducers to the air which is to carry the sound to the human ear. The primary disadvantage of an exponential horn resides in the excessive length, from its inlet to its outlet, required to transport without distortion, those sound frequencies at the low end of the audible spectrum.

Historically, it has been recognized that an exponential horn designed to produce an undistorted audible note of 30 Hertz from a 15 inch diameter woofer, requires that the loudspeaker be confined in a chamber of no less than 5200 cubic inches and having an outlet of 75 square inches matching the inlet opening (throat) of the horn, and that the horn must exceed 16 feet in length and terminate in a mouth opening equivalent to 127 square feet, or about 11 feet square. Further, if the inlet end of the horn is provided with a larger cross sectional area, for example to at least match the effective cross sectional area of a larger loudspeaker diaphragm, the outlet end of the exponential horn is even more unreasonably large. In any event, the folding of such a path requires an unacceptably large cabinet, at least for residential usage.

In order to utilize at least some of the benefits of an exponential horn, it has been the practice heretofore to couple the diaphragm of a loudspeaker to the inlet of the horn by means of a "slot" formed by a chamber which communicates with the loudspeaker and which also has an outlet "slot" or passageway, of smaller dimensions than the loudspeaker diaphragm but matching the inlet end of the horn. The cross sectional area of the chamber changes at random from the diaphragm to the slot. The cross sectional area of this outlet passageway generally is greater than about one-fourth the cross sectional area of the loudspeaker diaphragm. Nevertheless, such a reduction in cross sectional area of such a "slot", relative to the loudspeaker diaphragm, allows the dimensions of the exponential horn to be reduced to a degree that allows the horn to be folded within a cabinet of overall dimensions which render it practicable for use at least in large rooms. On the other hand, the size of such a cabinet is unsuitable for use in the average home, and further size reduction, through further reduction in the dimensions of the coupling slot diminishes the quality of sound reproduction to an unusable level.

SUMMARY OF THE INVENTION

In its basic concept, this invention provides for the coupling of an electrically driven sound reproducer to the atmosphere by means of a hollow coupler the cross sectional area of which decreases progressively from its inlet end to its outlet end.

It is by virtue of the foregoing basic concept that the principal objective of this invention is achieved; namely, to overcome the distortions resulting from the resonances which characterize the coupling devices of the prior art described hereinbefore.

Another important objective is to provide a coupler of the class described which may be associated with an exponential horn and which permits the folding of such a horn within a sound reproducer cabinet of such minimum volume as to render it practicable for use in conventionally sized residential rooms.

Another important objective of this invention is the provision of a sound reproducer coupler of the class described which, in association with an exponential horn, allows the inlet end of the horn to be reduced in cross sectional area many times smaller than has been possible heretofore, while maintaining maximum efficiency of sound transfer.

Still another important objective of this invention is the provision of a sound reproducer coupler of the class described which, in association with an exponential horn, provides for matching the acoustic resistance of the inlet of the exponential horn and the acoustic impedance of the sound reproducer associated therewith.

A further specific objective of this invention is the provision of a loudspeaker coupler of the class described in which minimization of the cross sectional area of the outlet end of the coupler serves beneficially to reduce substantially the loudspeaker diaphragm excursions required to produce a given sound level in the air, thereby correspondingly reducing distortions of the reproduced sounds.

A still further important objective of this invention is the provision of a sound reproducer coupler of the class described which is free of sound absorbing, throat choking material, whereby all of the sound from the loudspeaker is heard in substantially undamped condition throughout the audible spectrum, thereby contributing beneficially to an output characterized by crisp, lifelike sounds.

A further important objective of this invention is the provision of a loudspeaker coupler of the class described which is capable of utilizing the backwave sounds with minimum distortion and which may incorporate therewith a plurality of tweeters and other speakers arrayed in any desired manner.

The foregoing and other objectives and advantages of this invention will appear from the following detailed description, taken in connection with the accompanying drawings of preferred embodiments.

DESCRIPTION OF THE PREFERRED EMBODIMENTS

Figure 1:
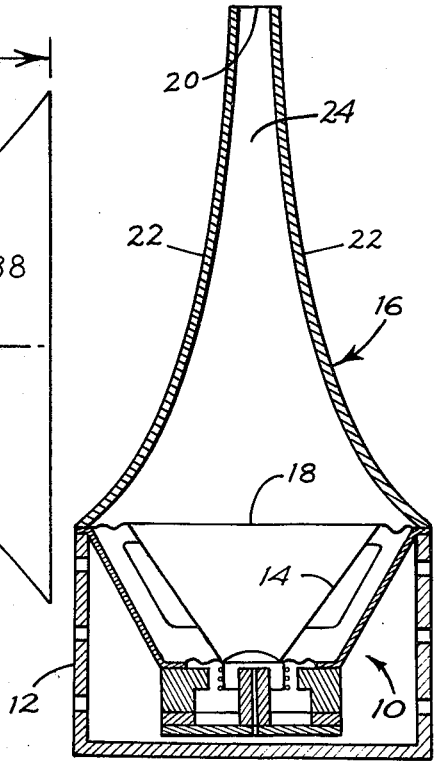
FIG. 1 is a schematic representation, in longitudinal section, of a loudspeaker having associated therewith a coupler embodying the features of this invention.

FIG. 1 illustrates a loudspeaker 10 supported in a housing 12, preferably perforated for exposure to atmospheric pressure. The electrically driven diaphragm 14 of the loudspeaker is coupled to the atmosphere through a hollow coupler 16 which, in accordance with this invention, provides an acoustically matched coupled between the loudspeaker and the environment, thereby minimizing distortions as are created by the resonant chambers and pipes which characterize the coupling devices of the prior art. As illustrated, the inlet end 18 of the coupler has a cross sectional area comparable to the effective cross sectional area of the diaphragm 14. Further, it is to be noted that the inlet end 18 is closed by the diaphragm and is sealed thereby against the passage of air or other fluid pressure. The outlet end 20 of the coupler, sometimes hereinafter referred to as the "bore" is of substantially smaller cross sectional area, as discussed more fully hereinafter.

The coupler may take a variety of shapes. Thus, the coupler in FIG. 1 may be generated symmetrically about a common longitudinal axis, as in the case in FIG. 2 described hereinafter. It may be rectangular in cross section, with the sides 22 converging progressively from the inlet end 18 to the outlet end 20 as illustrated, and with the opposite sides 24 being disposed either parallel to each other or converging progressively from the inlet end 18 to the outlet end 20.

The sides of the coupler may be constructed of a variety of materials. They may be made of materials such as Firtex, or other particle boards and constructed so they flex and thereby respond to the internal air pressures generated by the loudspeaker or other form of sound reproducer. The responsive surfaces of such materials radiate the sounds to the atmosphere devoid of the usual resonances described hereinbefore, and the progressive change of cross sectional area eliminates the distortions also referred to hereinbefore. When made of these types of materials, the coupler may serve as the only medium by which the sound reproducer is coupled to the atmosphere, by providing a larger surface for radiating the sound than the speaker diaphragm itself.

On the other hand, the coupler may function to couple a loudspeaker or other sound reproducer to the inlet of an exponential horn. In such instances, it is preferred that the sides of the coupler be made so that they are substantially inflexible and thereby do not respond efficiently to the internal pressures generated by the reproducer. Materials for this type of coupler include a variety of synthetic thermosetting and thermoplastic resins, wood, ceramic, and others.

Figure 2:
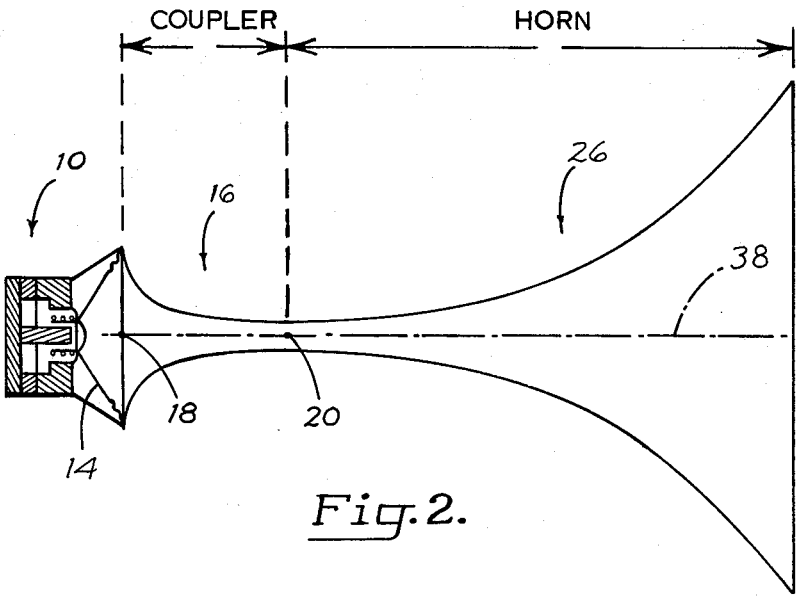
FIG. 2 is a schematic representation, in plan view, illustrating the manner in which the diaphragm of a loudspeaker is coupled to the inlet of an exponential horn in accordance with this invention.

Referring now to FIG. 2 of the drawings, there is illustrated schematically an exponential horn 26 the inlet end of which is generally referred to as the "throat" and is coupled to the electrically driven diaphragm 14 of the loudspeaker 10 through a hollow coupler 16. As explained hereinbefore, the inlet end 18 of the coupler preferably has a cross sectional area comparable to the effective cross sectional area of the diaphragm 14 and is closed and sealed by the latter. The outlet end, or "bore" 20 of the coupler and the throat 20' of the horn are connected at the same transverse plane and therefore obviously have the same cross-sectional area and shape.

The arrangement illustrated in FIG. 2 achieves a fundamental objective of this invention; namely, the acoustic resistance of the bore 20 matches the reflective impedances of both the coupler 16 and horn 26, whereby to effect cancelling of acoustic resonances in either. This is analogous to the termination of an electrical transmission line by a resistor equal in value to the characteristic impedance of the transmission line, whereby to effect cancelling of reflected waves.

Figure 3:
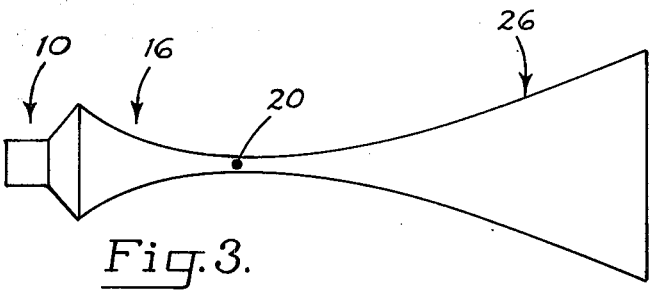
FIGS. 3, 4 and 5 are schematic representations, in plan view, illustrating various structural arrangements accommodating the coupling concept of this invention.
Figure 3A:
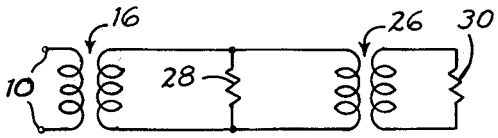
FIGS. 3a, 4a and 5a are electrical diagrams illustrating the equivalent electrical circuits representing the structural configurations of FIGS. 3, 4 and 5, respectively.

Thus, referring to FIGS. 3 and 3a of the drawings, wherein FIG. 3 is the same as FIG. 2, the transformer 26 in FIG. 3a represents the electrical equivalence of the exponential horn 26 and the transformer 16 represents the electrical equivalence of the coupler 16. The resistor 28 represents the electrical equivalence of the throat resistance and the resistor 30 represents the electrical equivalence of the room resistance. This arrangement substantially improves the acoustic impedance matching of the speaker 10 through the exponential compression transformer 16 to a resistive load 28 at the junction 20 between the coupler 16 and the exponential horn 26. This resistive load 28 matches the impedance of the input end of the exponential horn 26 with the open end of the horn matching the very high impedance of the sound-carrying air within a room.

Accordingly, it will be apparent that it is primarily the ratio of the cross sectional areas of the closed inlet end 18 of the coupler 16 and the outlet end 20 thereof that determines whether the magnitude of acoustic resistance is sufficient to render the hollow coupler non-resonant. The effective cross sectional area of the outlet end 20 is reduced somewhat by forming the coupler walls 22 and 24 of such sound absorbing materials as Firtex and others, as previously mentioned. Thus, the condition of non-resonance is established by measurements of sound levels at given frequencies attributable to couplers of different materials having different inlet and outlet ratios, the condition of non-resonance being exhibited by the lack of variations in sound levels at given frequencies.

Figure 4:
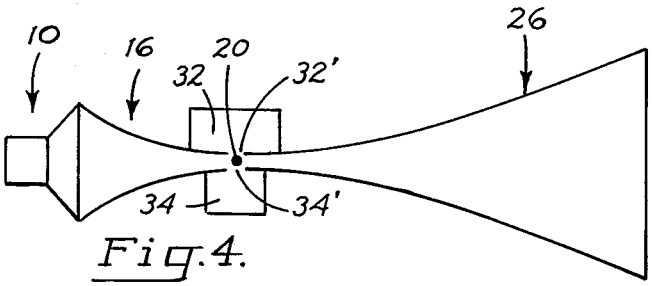
Figure 4A:
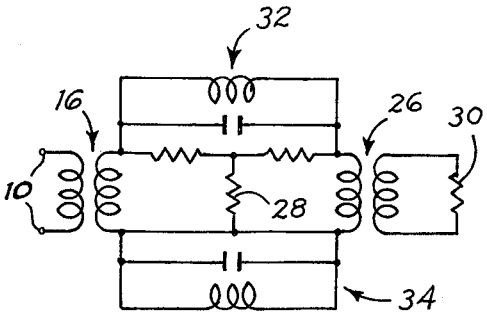

FIG. 4 illustrates a modification of FIG. 3 by the incorporation of one or more resonant chambers, two such chambers 32 and 34 of different volumes being illustrated, each communicating with the throat 20 through a radial opening 32', 34' therein.

Figure 5:
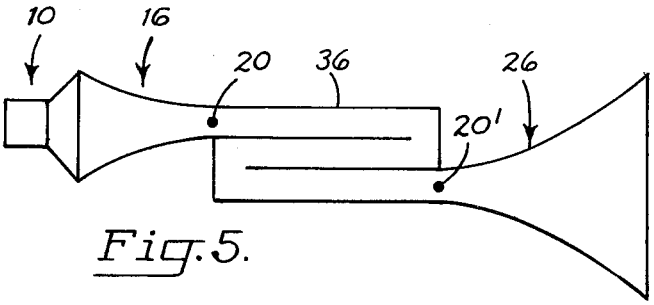
Figure 5A:
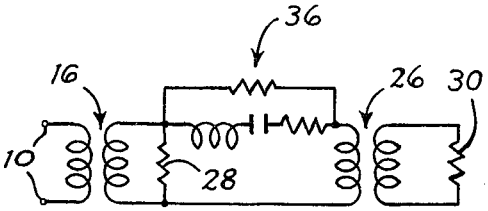

In FIG. 5, one or more tuned pipes 36 are interposed between the bore and throat. Although only one such tuned pipe is illustrated, it will be understood that a plurality of differently tuned pipes may be disposed side-by-side within the transverse dimensions of a loudspeaker enclosure, as will become apparent hereinafter.

In FIG. 2, the combination of loudspeaker diaphragm 14, coupler 16 and exponential horn 26 is shown to be generated symmetrically about a common longitudinal axis 38. In practice, however, loudspeaker cabinets generally are rectangular in shape, as illustrated in FIGS. 6–10. Accordingly, since loudspeaker diaphragms are usually circular in cross section, it is necessary that the transition from the circular cross section of the diaphragm to the rectangular cross section of the cabinet be made in such a manner that the rectangular cross sectional area immediately adjacent the diaphragm is comparable, i.e. approximately equal, to the effective cross sectional area of the diaphragm. Ideally, it is desirable that the cabinet be provided with a transition volume by which the circular cross section of the cabinet opening registering with and matching the effective cross sectional area of the loudspeaker diaphragm, be converted to an outlet opening of rectangular cross section of equal area. This ideal arrangement is provided in the embodiment illustrated in FIGS. 9 and 10 and described in detail hereinafter.

Figure 7:
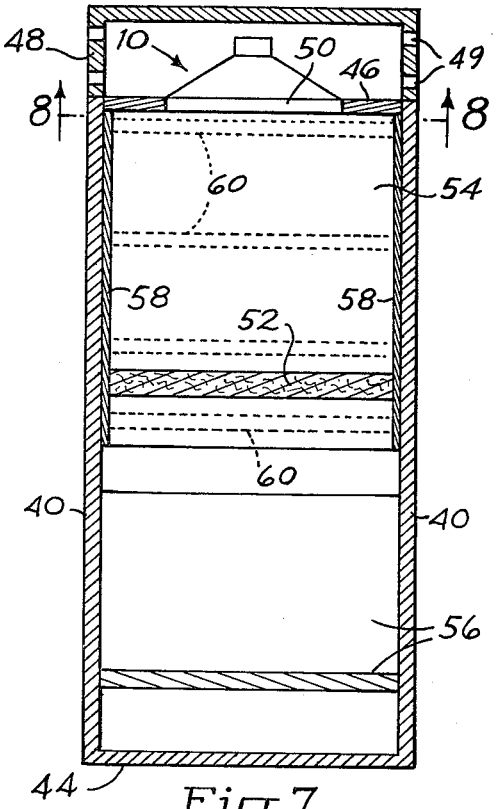
FIG. 7 is a sectional view taken on the line 7—7 in FIG. 6.
Figure 6:
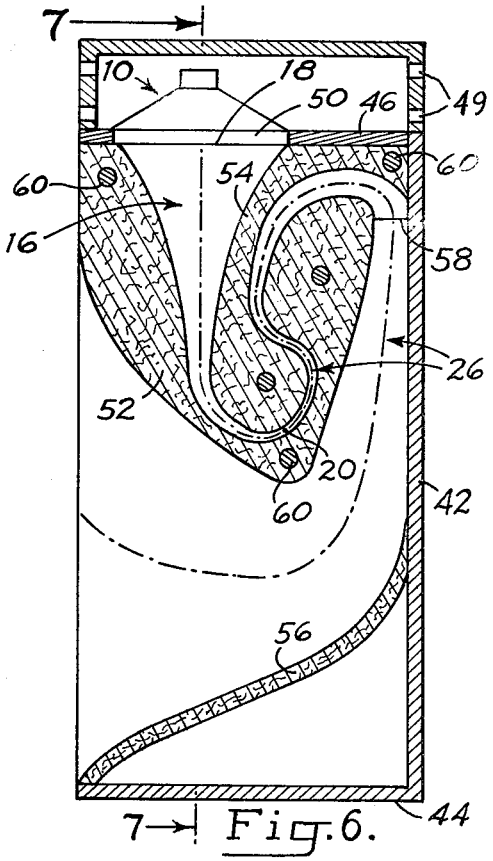
FIG. 6 is a vertical cross section through a loudspeaker enclosure embodying the features of this invention.
Figure 8:
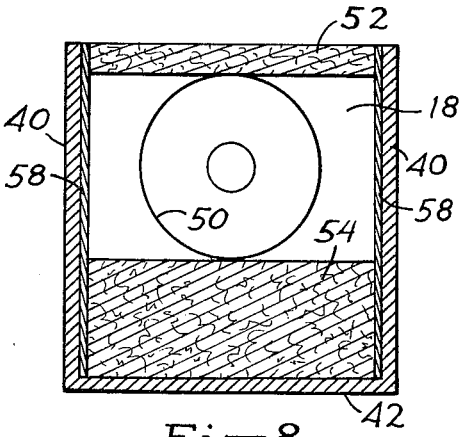
FIG. 8 is a sectional view taken on the line 8—8 in FIG. 7.

Referring first to the embodiment illustrated in FIGS. 6, 7 and 8, the cabinet is formed of side walls 40, back wall 42, bottom wall 44, top wall 46 which supports the loudspeaker 10, and cover 48, which conceals the loudspeaker.

The top wall 46 is provided with a circular opening 50 having a cross sectional area equal to the effective cross sectional area of the diaphragm of the loudspeaker. It is through this circular opening that the loudspeaker communicates with and closes the inlet end 18 of the coupler 16, the outlet end, or bore 20 of which communicates with the inlet end, or throat, of the exponential horn 26.

The coupler 16 and exponential horn 26 may be provided within the cabinet by various construction techniques. In the embodiment illustrated in FIGS. 6, 7 and 8, the interior of the cabinet is fitted with preformed structural sections 52,54 and 56 which cooperate with the cabinet walls to provide between them the hollow coupler 16 and exponential horn 26. The sections may be formed of any desired material, such as wood, rubber, paper, fiberboard, synthetic thermoplastic or thermosetting resins, or other suitable material, and by any well known procedure, such as molding, stamping, fabricating, or other desired techniques.

In the embodiment illustrated, the sections 52 and 54 are formed of a mixture of rubber and synthetic thermoplastic resin and supported in properly spaced-apart relation by means of the end support plates 58 and the laterally extending dowel pins 60.

The integrated assembly of sections 52 and 54 with structural plates 58 may be secured within the cabinet by any suitable means, such as adhesive, screws, etc.

It is to be noted, particularly from FIG. 8 of the drawings, that the inlet end 18 (FIG. 6) of the coupler 16 is of rectangular cross section and somewhat larger in area than the cross sectional area of the circular opening 50 in the top wall 46. Although some loss of fidelity of sound transfer results from this less than ideal arrangement, it has been found that the loss is more technical than apparent to the human ear, and therefore the arrangement, in which the cross sectional areas of the opening 18 and diaphragm 14 are comparable, is quite adequate for all practicable purposes.

It is to be noted from FIG. 6 that the coupler 16 extends from its inlet end 18 downward to its outlet at point 20 of minimum cross sectional dimension. This "bore" also is the inlet or "throat" of the exponential horn 26 which, in its folded condition, extends upward toward the rear of the cabinet between the forming sections 52 and 54 and thence downward between the back wall 40 of the cabinet and forming section 52, thence forward to the open front of the cabinet. Typical dimensions for this cabinet are 38" high, 17" wide and 18" deep, accommodating a 12" diameter cone speaker.

Experiments conducted with the illustrated arrangement have shown that the size of the bore 20 has been reduced to as small as 0.2" in height by 15" in width and has performed successfully with a 12" diameter speaker. This cross sectional area is 1/38 that of the speaker. Of particular interest is the observation that speakers of smaller diameter but of comparable quality may be utilized in this cabinet, with no noticeable loss in performance.

Further, such experiments have also shown that frequencies well below the theoretical cut-off limit of the horn itself are passed without large attenuation, as expected by cut-off calculations. For example, a horn and coupler assembly calculated to provide undistorted transmission of a minimum 65 Hertz note, actually passed an undistorted 12 Hertz note.

The internal section 56 is illustrated as being formed of a curved section of wood secured to the walls of the cabinet by any suitable means. It may be formed of the same material as the sections 52 and 54. If desired, it may be formed in segments, in which case the support plates 58 are extended downward to the bottom wall 44 of the cabinet to support the segments of section 56, in the same manner as previously described.

Figure 9:
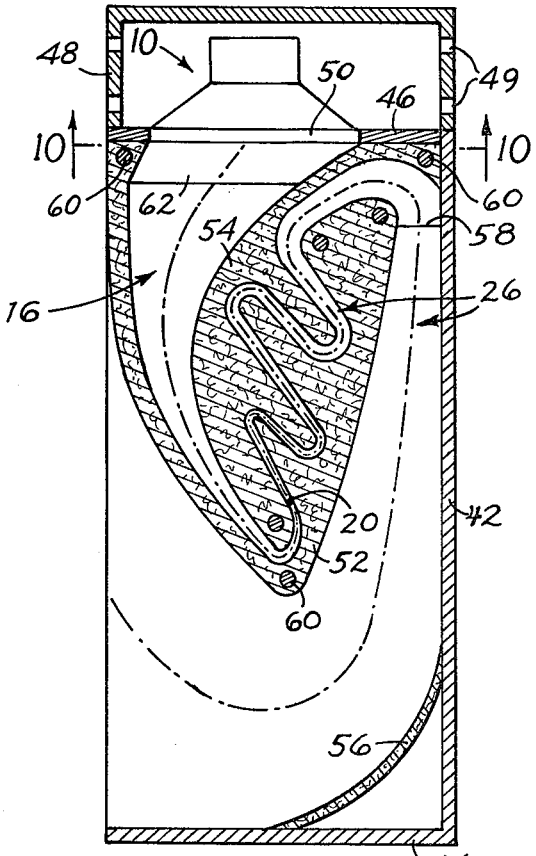
FIG. 9 is a vertical cross section through a loudspeaker enclosure illustrating a second embodiment of this invention.
Figure 10:
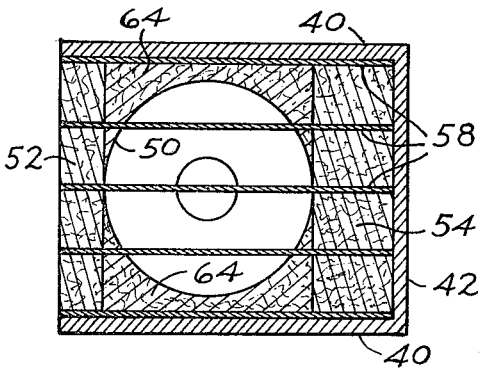
FIG. 10 is a sectional view taken on the line 10—10 in FIG. 9.

FIGS. 9 and 10 illustrate a structural arrangement in which the coupler 16 extends from its inlet downward and thence rearward and upward to the point 20 of minimum opening. This is the bore of the coupler 16 and the throat of the exponential horn 26, as previously explained. The horn progresses upward and rearward, in surpentine fashion, and thence downward and forward to the open front of the cabinet. The arrangement illustrated provides, within a cabinet 40" high, 15" wide and 22" deep, housing a 12" diameter loudspeaker, an exponential horn having an overall length of 10'. This provides for the undistorted transmission of sound frequencies as low as 30 Hertz.

The embodiment of FIGS. 9 and 10 also illustrates means providing a transition volume 62 by which the circular cross section of the opening 50 in the top wall 46, registering with, closed by and matching the effective cross sectional area of the diaphragm of the loudspeaker 10, is converted to rectangular cross section of equal area. This transition volume is provided by associating with the upper portions of the segments 52 and 54, preformed sections 64 which span the space between the upper portions of the sections 52 and 54. These sections 64 have semi-circular inner edges at their top and a straight edge at their bottom end, merging with the side walls 40 of the cabinet. This transition volume is an integral part of the coupler 16 and provides the ideal structural arrangement referred to hereinbefore, since it converts the circular cross section of opening 50 to the rectangular cross section of equal area.

As noted hereinbefore, the preferred coupler 16 of this invention is characterized by having an inlet 18 closed and sealed by diaphragm 14 and of cross sectional area comparable to the effective cross sectional area of the loudspeaker 10. it also has an outlet 20, or bore, of cross sectional shape generally matching the cross sectional shape of its inlet, but much smaller in dimensions. The shape and cross sectional area of the bore matches the cross sectional shape and area of the inlet, or throat of the exponential horn.

Additionally, the coupler of this invention has a cross sectional area which decreases progressively from its inlet to its outlet. This progressive decrease in cross sectional area may be uniform, providing the coupler with the shape of a truncated cone (FIG. 2) or wedge (FIG. 6). As previously mentioned, all four sides may decrease in cross sectional area progressively from its inlet to its outlet. In the preferred form of coupler, the cross sectional area decreases exponentially.

Thus, in the embodiment illustrated in FIGS. 6 and 9, although the lateral sides of the coupler are parallel, being defined by the lateral sides 40 of the cabinet, the front and back walls defining the depth dimensions of the coupler are curved exponentially. Although a variety of configurations is suitable for this purpose, the hyperbolic curve has been found to provide optimum results.

The coupler 16 of this invention provides many advantages: It functions to provide acoustic damping upon any remote tendency toward resonance within the coupler, by virtue of the true acoustic resistance quality of the bore 20. With loudspeakers of the movable diaphragm type, it reduces the excursions required to produce a given sound level in the air. By thus reducing Hook's law forces, corresponding reduction in sound reproduction distortions also is achieved, from both front and back sides of the speaker.

The damped horn characteristics of the coupler render it useful for driving resonant chambers for special effects.

It is by virtue of the provision of the hollow coupler that the inlet end of the exponential horn may be reduced to minimum cross sectional area without introducing acoustic distortions and other deleterious factors. Minimization of the cross sectional area of the inlet end of the horn beneficially affords minimizing the size of the cabinet in which to contain the horn, by allowing the horn to be folded in a variety of ways to minimize the volume containing it.

The provision of the coupler functions to match the acoustic resistance of the bore with the reflected impedances of both the coupler and exponential horn, whereby to provide for maximum transfer of energy from the speaker to the environment. By collecting the sound through purposeful compression in the coupler into a high acoustical impedance and then guiding the sound expansion exponentially through the horn, the virtual radiating surface is enlarged many times, with a marked improvement in the ability to reproduce low frequency sounds, as well as the higher frequency sounds throughout the audible spectrum.

Many variations of the structural arrangements illustrated in the drawings may be made. For example, the outlet end of the coupler may communicate with the inlet end of a passageway of uniform cross section, the outlet end of which communicates with the inlet end of the exponential horn. This passageway may be one or more tuned pipes, as illustrated in FIG. 5 and described hereinbefore. The outlet end of the coupler may communicate both with the inlet end of the exponential horn and with one or more resonant chambers, as illustrated in FIG. 4, if it is desired to alter the characteristics of the loudspeaker such as to alter its resonant peaks or to extend its frequency-amplitude performance. In all instances, the coupler performs its function of impedance matching as described hereinbefore.

In the embodiment illustrated in the drawings, the loudspeaker is shown arranged with the front side of the diaphragm feeding the coupler. It will be understood, of course, that the disposition of the speaker may be reversed, with the back side of the diaphragm feeding the coupler. Further, sound reproducers other than the electromagnetically driven diaphragm type illustrated and described hereinbefore, are intened to be included in the general term "loudspeaker", as utilized in the specification and claims. Such other sound reproducers include electrostatic speakers, the Keff woofer, the Magnaplaner, and others.

FIGS. 6–10 show the cabinet provided with a cover 48 which encloses the loudspeaker. It is preferred that the cover be perforate, as illustrated by openings 49, maintaining atmospheric conditions within it. Such an arrangement allows for the utilization of the back wave sounds from the speaker. This enhances stereo imaging. Such a cover may serve to conceal within it a plurality of tweeters and other speakers arrayed to provide most effective distribution of sounds in the medium and higher frequency portion of the spectrum.

On the other hand, the cover may be imperforate and designed to provide a resonant chamber for the purpose of altering speaker performance as a horn driver, also as is well known in the art.

The cabinet illustrated and described hereinbefore may be formed in a variety of ways and in a variety of shapes and sizes. Indeed, the assembly of internal sections 52 and 54, integrated by plates 58 to form the coupler and horn chanels, together with the top wall 46 supporting the loudspeaker 10, may be associated in a variety of ways with surfaces of tables and ceiling, floor and wall components of a room effectively to provide an enclosure for the assembly, in the manner of the cabinet described hereinbefore by which to complete the hollow coupler and exponential horn.

The cabinets illustrated in FIGS. 6 and 9 may be formed in sections to facilitate portability. For example, the portion below the section 52 may be formed separately, for detachable connection to the upper section.

It will be understood, of course, that the cabinets may be turned upside down for use. If the cabinet is sectioned, the section including member 56 may be omitted and replaced by surfaces of furniture, walls, etc.

A plurality of couplers may be utilized as a coupler system with one or more loudspeakers as a loudspeaker system, and a single coupler as a coupler system may be utilized with a plurality of loudspeakers as a loudspeaker system, provided the total cross sectional area of the common inlet of the coupler system and the total effective cross sectional area of the associated loudspeaker system are comparable.

It will be apparent to those skilled in the art that various other changes may be made in the size, shape, type, number and arrangement of parts described hereinbefore, without departing from the spirit of this invention.

Having now described our invention and the manner in which it may be used, we claim:

1. In combination with a loudspeaker, a hollow, nonresonant coupler having an open outlet end and an open inlet end communicating with and closed by the loudspeaker, the coupler having substantially inflexible walls that are substantially unresponsive to the internal air pressure generated by the loudspeaker, to inhibit radiation of sounds to the atmosphere, the cross sectional area of the hollow coupler decreasing progressively from its inlet end to its outlet end, and a horn having an inlet end communicating with and substantially matching the cross sectional area and shape of the outlet end of the hollow coupler.

2. The combination of claim 1, wherein the loudspeaker system comprises a single loudspeaker and the coupler system comprises a single hollow coupler having an open outlet end and an open inlet end communicating with and closed by the loudspeaker, the cross sectional area of the hollow coupler decreasing progressively from its inlet end to its outlet end.

3. The combination of claim 2 wherein the loudspeaker has a round cross sectional shape and the inlet end of the coupler has a rectangular cross sectional shape, and including means forming a transition volume at the inlet end of the hollow coupler for converting the cross sectional shape of the loudspeaker to the cross sectional shape of the inlet end of the coupler, with substantially the same cross sectional area.

4. The combination of claim 2 wherein the progressive decrease in cross sectional area of the hollow coupler from its inlet end to its outlet end is exponential.

5. The combination of claim 2 wherein the hollow coupler has a generally rectangular cross section of substantially uniform width and progressively decreasing depth from its inlet end to its outlet end.

6. The combination of claim 5 wherein the shape of the surfaces defining said progressively decreasing depth is hyperbolic.

7. The combination of claim 1 including a cabinet having side, rear, top and bottom walls, and transverse partitions in the cabinet cooperating with the walls of the latter to form said horn and said hollow coupler.

8. The combination of claim 7 wherein the transverse partitions form with the cabinet walls a hollow coupler extending downward from its inlet to its outlet end, and a folded horn extending from its inlet end at the outlet end of the coupler upward and rearward and thence downward and forward to the front side of the cabinet.

9. The combination of claim 7 wherein the transverse partitions form with the cabinet walls a hollow coupler extending downward from its inlet end to an intermediate portion and thence upward therefrom to its outlet end, and a folded horn extending from its inlet end at the outlet end of the coupler upward and rearward in surpentine manner, and thence downward and forward to the front side of the cabinet.

10. The combination of claim 7 wherein the top of the cabinet enclosing the loudspeaker is a perforate cover.

11. The combination of claim 2 wherein the cross sectional area of the inlet end of the coupler is substantially the same as the effective cross sectional area of the loudspeaker.

12. For use with a loudspeaker and an enclosure having side, back, top and bottom walls, wherein the top wall has an opening therethrough registering with a loudspeaker mounted on the top wall, a unitary assembly of transverse partitions arranged for installation within the enclosure and forming with the latter a hollow, non-resonant coupler extending from its inlet end registering with and closed by the loudspeaker to its outlet end registering with the inlet end of a horn also formed by the enclosure and partition assembly, the inlet end of the coupler having a cross sectional area approximately equal to the effective cross sectional area of the loudspeaker and the outlet end of the coupler and inlet end of the horn having the same cross sectional area and shape, the coupler having substantially inflexible walls that are substantially unresponsive to the internal air pressure generated by the loudspeaker, to inhibit radiation of sounds to the atmosphere, the cross sectional area of the coupler decreasing progressively from its inlet end to its outlet end.

13. The unitary assembly of claim 12 wherein the transverse partitions include a plurality of laterally disposed segments interleaved with support plates, the segments and plates being secured together as an integral unit.

14. For use with structures forming spaced side and rear surfaces of the outlet portion of horn, a loudspeaker, a unitary assembly of transverse partitions secured in spaced apart relationship and contoured to form a hollow, non-resonant coupler and an inlet portion of a horn, the coupler having an inlet end registering with and having a cross sectional area approximately equal to the effective cross sectional area of and closed by the loudspeaker and an outlet end registering with and matching the shape of the inlet end of the horn inlet portion, the coupler having substantially inflexible walls that are substantially unresponsive to the internal air pressure generated by the loudspeaker, to inhibit radiation of sounds to the atmosphere, the cross sectional area of the coupler decreasing progressively from its inlet end to its outlet end.

15. In combination with a loudspeaker, a hollow, non-resonant coupler having an open outlet end and an open inlet end communicating with and closed by the loudspeaker, the coupler having substantially inflexible walls that are substantially unresponsive to the internal air pressure generated by the loudspeaker, to inhibit radiation of sounds to the atmosphere, the cross sectional area of the hollow coupler decreasing progressively from its inlet end to its outlet end.

* * * * *